US006997092B2

(12) United States Patent
Lin

(10) Patent No.: US 6,997,092 B2
(45) Date of Patent: Feb. 14, 2006

(54) CUTTING APPARATUS

(75) Inventor: Chien-Fu Lin, Taichung (TW)

(73) Assignee: Chau Lih Rong Enterprise Co., Ltd., Taichung (TW)

( * ) Notice: Subject to any disclaimer, the term of this patent is extended or adjusted under 35 U.S.C. 154(b) by 45 days.

(21) Appl. No.: 10/449,400

(22) Filed: Jun. 2, 2003

(65) Prior Publication Data

US 2004/0237744 A1 Dec. 2, 2004

(51) Int. Cl.
*B26D 5/10* (2006.01)
*B26D 5/18* (2006.01)
*B26D 7/02* (2006.01)

(52) U.S. Cl. ..... 83/588; 83/378; 83/563; 83/620; 83/626; 83/630; 83/635; 83/632; 83/687; 83/697; 83/948; 83/604

(58) Field of Classification Search ..... 83/563, 83/588–590, 948, 618, 628, 630, 632–635, 83/569, 687, 691, 697, 589, 684, 139, 625, 83/626, 378, 620, 616, 602, 604, 605; 74/286, 74/22 A, 44, 47, 48, 105, 106, 107
See application file for complete search history.

(56) References Cited

U.S. PATENT DOCUMENTS

| | | | | | |
|---|---|---|---|---|---|
| 685,212 | A | * | 10/1901 | Knowlton | 83/597 |
| 1,146,089 | A | * | 7/1915 | Neely | 83/625 |
| 2,132,047 | A | * | 10/1938 | Rix | 83/146 |
| 3,215,016 | A | * | 11/1965 | Olson | 83/468.93 |
| 3,261,250 | A | * | 7/1966 | Parks et al. | 83/557 |
| 3,640,161 | A | * | 2/1972 | Kuhns | 83/36 |
| 4,194,423 | A | * | 3/1980 | Cutler, Jr. | 83/589 |
| 5,172,622 | A | * | 12/1992 | Sabin | 83/520 |
| 5,255,587 | A | * | 10/1993 | Eichenberg et al. | 83/628 |
| 5,778,748 | A | * | 7/1998 | Beijen | 83/529 |

* cited by examiner

*Primary Examiner*—Boyer D. Ashley
(74) *Attorney, Agent, or Firm*—Birch, Stewart, Kolasch & Birch, LLP

(57) ABSTRACT

A photo cutting apparatus includes a support, a press, a linkage and a cutting device. The press is movably mounted on the support. The linkage is for pressing the press. The cutting device is arranged between the support and the press for separating photos developed on a sheet from one another in a single action.

18 Claims, 11 Drawing Sheets

CUTTING APPARATUS

FIELD OF INVENTION

The present invention relates to photos and, more particularly, to a cutting apparatus for separating photos developed on a same sheet.

BACKGROUND OF INVENTION

Referring to FIG. 12, a conventional paper shearing apparatus 1 is shown. The paper shearing apparatus 1 includes a platform 2, a first knife 5 secured to a side of the platform 2 and a second knife 3 pivotally attached to the side of the platform 2 in order to cooperate with the first knife 5 as a pair of shears. In use, the second knife 3 is lifted from the first knife 5. A sheet 4 is put between the first knife 5 and the second knife 3. A first portion of the sheet 4 is put on the platform 2 and a second portion of the sheet 4 is located beyond the platform 2. The second knife 5 is pivoted toward and past the first knife 3, thus shearing the second portion of the sheet 4 from the first portion of the sheet 4. It is desired that a straight edge is formed of the first portion of the sheet 4 and a straight edge is formed of the second portion of the sheet 4 because of the shearing. The sheet 4 is, however, always deformed during the shearing, thus forming a curved edge of the first portion of the sheet 4 and a curved edge of the second portion of the sheet 4. In addition, the second knife 3 is intended to pivot in a plane in which the first knife 5 is located in order to shear. The second knife 3 is however biased from that imaginary plane during the shearing and particularly so when cutting a stack of sheets or a thick sheet.

The present invention is therefore intended to obviate or at least alleviate the problems encountered in prior art.

SUMMARY OF INVENTION

It is an objective of the present invention to provide a photo cutting apparatus for precisely cutting photos developed on a sheet from one another.

It is another objective of the present invention to provide a photo cutting apparatus for cutting a thick sheet on which photos are developed.

It is another objective of the present invention to provide a photo cutting apparatus for cutting photos developed on a sheet from one another in a single action.

According to the present invention, a photo cutting apparatus includes a support, a press, a linkage and a cutting device. The press is movably mounted on the support. The linkage is used for pressing the press. The cutting device is arranged between the support and the press for separating photos developed on a sheet from one another in a single action.

Other objects, advantages and novel features of the invention will become more apparent from the following detailed description in conjunction with the attached drawings.

BRIEF DESCRIPTION OF DRAWINGS

The present invention will be described via detailed illustration of embodiments referring to the drawings.

DETAILED DESCRIPTION OF EMBODIMENTS

Figure 1:
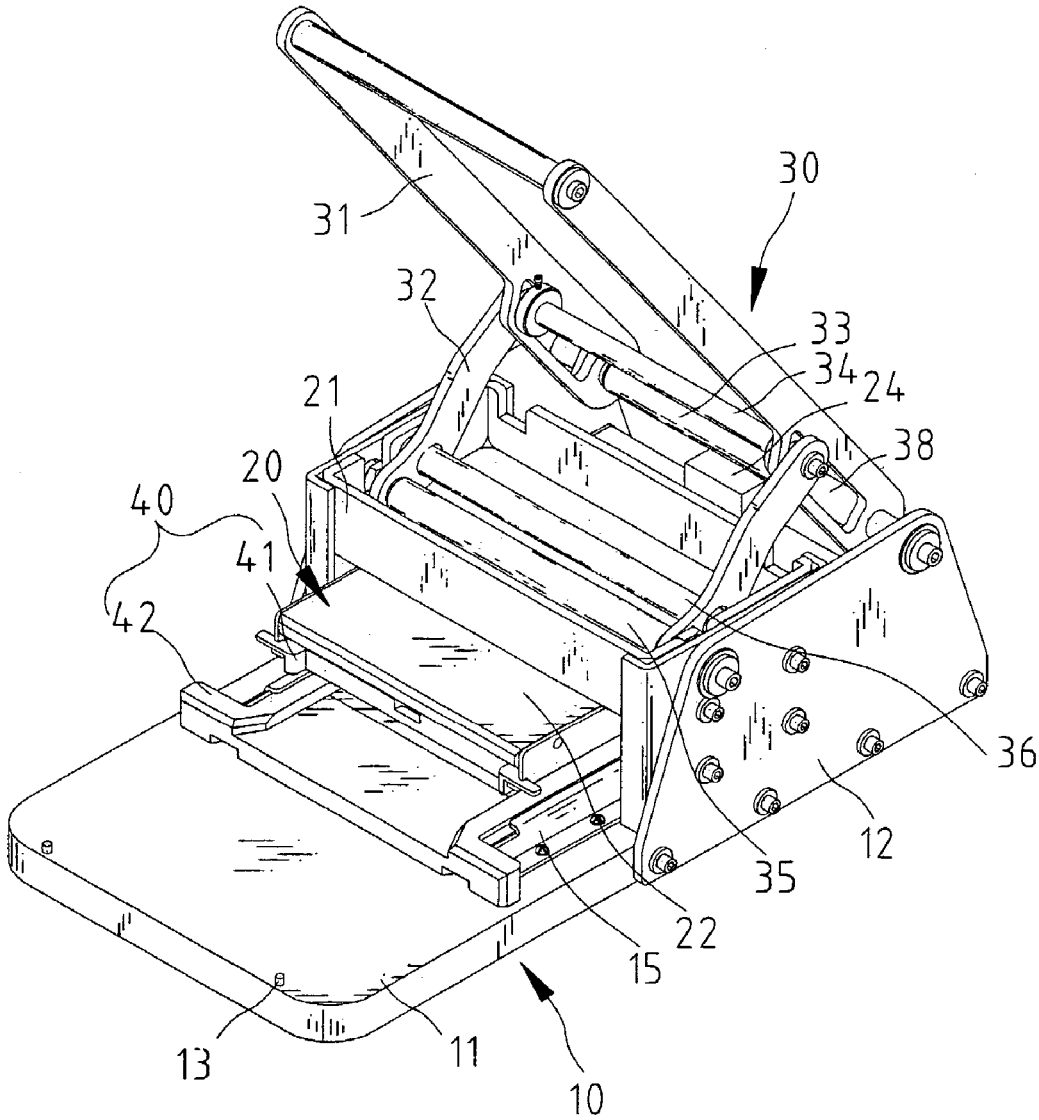
FIG. 1 is a perspective view of a photo cutting apparatus according to a first embodiment of the present invention.

Referring to FIG. 1, a photo cutting apparatus according to a first embodiment of the present invention is shown.

Figure 2:
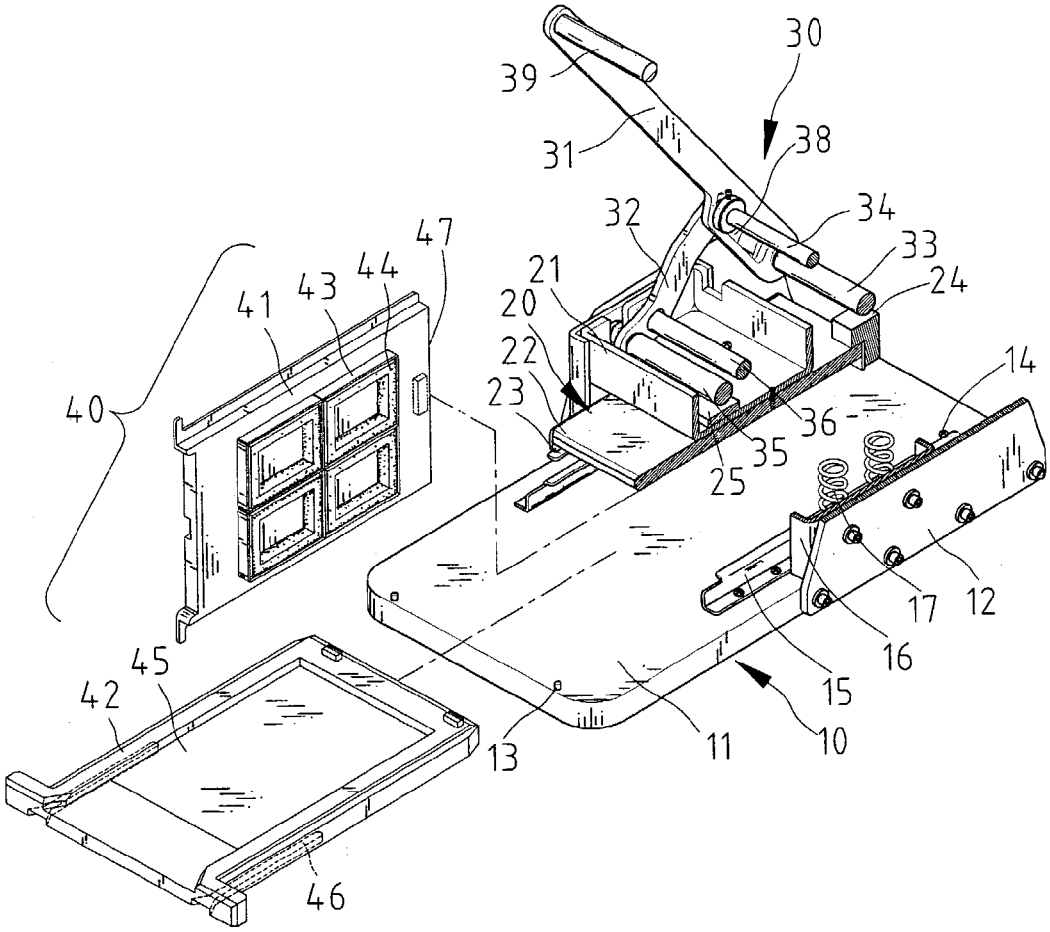
FIG. 2 is an exploded view of the photo cutting apparatus shown in FIG. 1.
Figure 3:
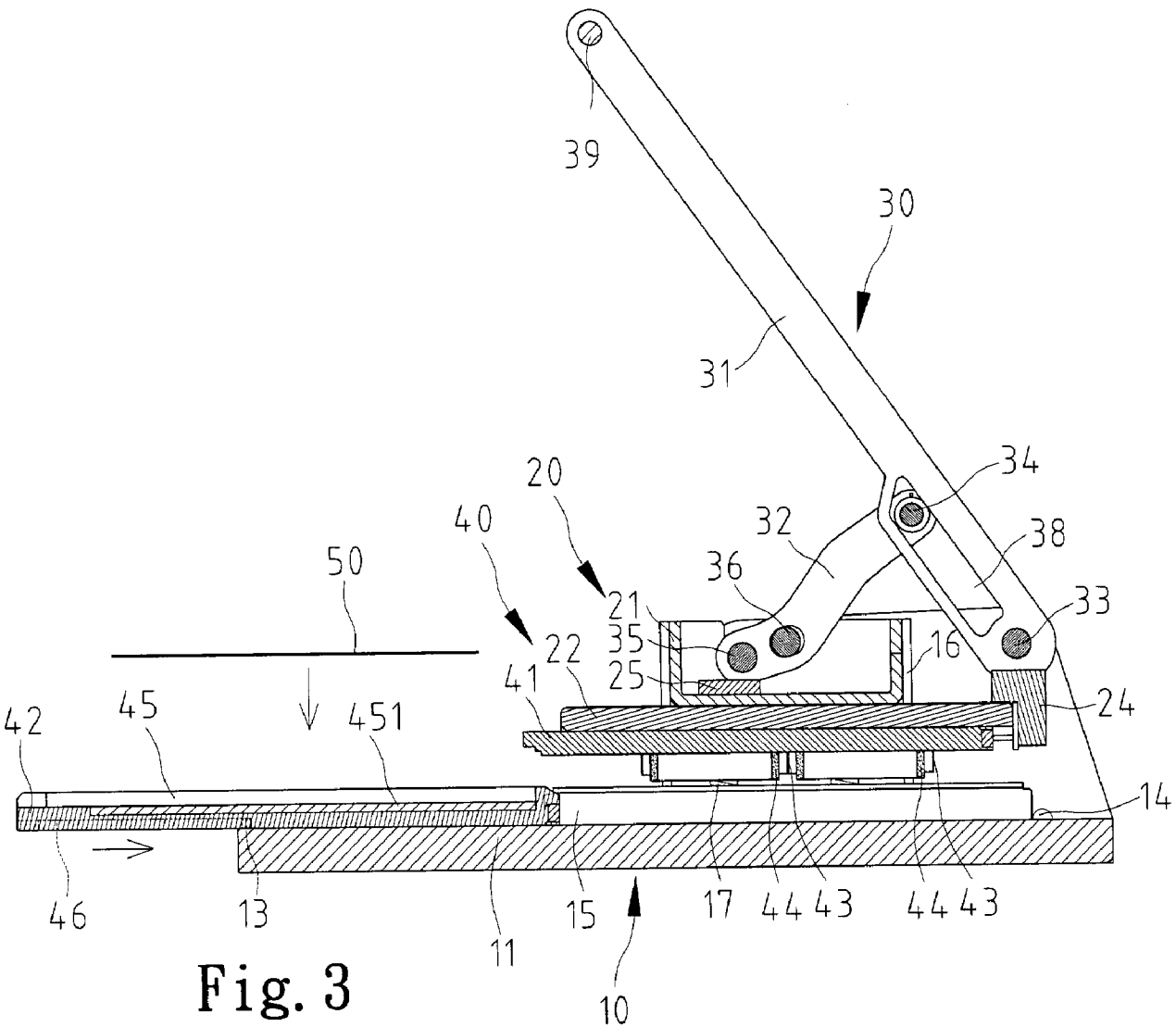
FIG. 3 is a cross-sectional view of the photo cutting apparatus shown in FIG. 1.

Referring to FIGS. 2 and 3, the photo cutting apparatus includes a support 10, a press 20 movably mounted on the support 10, a linkage 30 for pressing the press 20 and a cutting device 40 arranged between the support 10 and the press 20 for cutting a sheet 50 (see FIG. 4) on which four photos are developed.

The support 10 includes a platform 11, two bosses 13 formed on the platform 11, two stops 14 formed on the platform 11, two rails 15 mounted on the platform 11, two walls 12 each attached to a side of the platform 11, two frames 16 each attached to one of the walls 12 and four springs 17 (only two are shown) two of which are located within each of the frames 16.

The press 20 includes a box-shaped element 21 in sliding engagement with the frames 16 and for contact with the springs 17, a board 22 secured to the box-shaped element 21 for contact with the cutting device 40, two rails 23 secured to the board 22 for engagement with the cutting device 40, a front pad 25 mounted on the box-shaped element 21 and a rear pad 24 mounted on the board 22.

The linkage 30 includes two levers 31 and two toggles 32. Each of the levers 31 includes a lower end, an upper end and a slot 38 defined therein. An axle 33 is used for pivotally connecting the lower ends of the levers 31 with the walls 12. A handle 39 is connected between the upper ends of the levers 31. Each of the toggles 32 includes a lower end, an upper end and a protrusion formed between the ends thereof. An axle 34 is inserted through the slots 38. The upper end of each of the toggles 32 is pivotally connected with an end of the axle 34. An axle 35 is used for pivotally connecting the lower ends of the toggles 32 with the walls 12. An axle 36 is used for pivotally connecting the toggles 32 with the box-shaped element 21.

The cutting device 40 includes a cutter 41 for sliding engagement with the rails 23 and an anvil 42 for sliding engagement with the rails 15. The cutter 41 includes a board 47 and a blade 43 projecting from the board 47 for separating the photos from one another in a single action. The blade 43 assumes the form of a grid defining four cells corresponding to the photos. An elastic frame 44 is put in each of the cells defined by means of the blade 43. The anvil 42 defines a cavity 45 in an upper side and two grooves 46 in a lower side.

Referring to FIG. 3, in use, the cutter 41 is attached to the board 22 via sliding due to the rails 23 engaged with two edges thereof. The sheet 50 is put in the cavity 45. The anvil 42 is smoothly slid onto the platform 11 due to the rails 15 engaged with two edges thereof. The sliding of the anvil 42 continues until it contacts the stops 14. The bosses 13 are put in the grooves 46 in order to precisely locate the bard 42.

Figure 4:
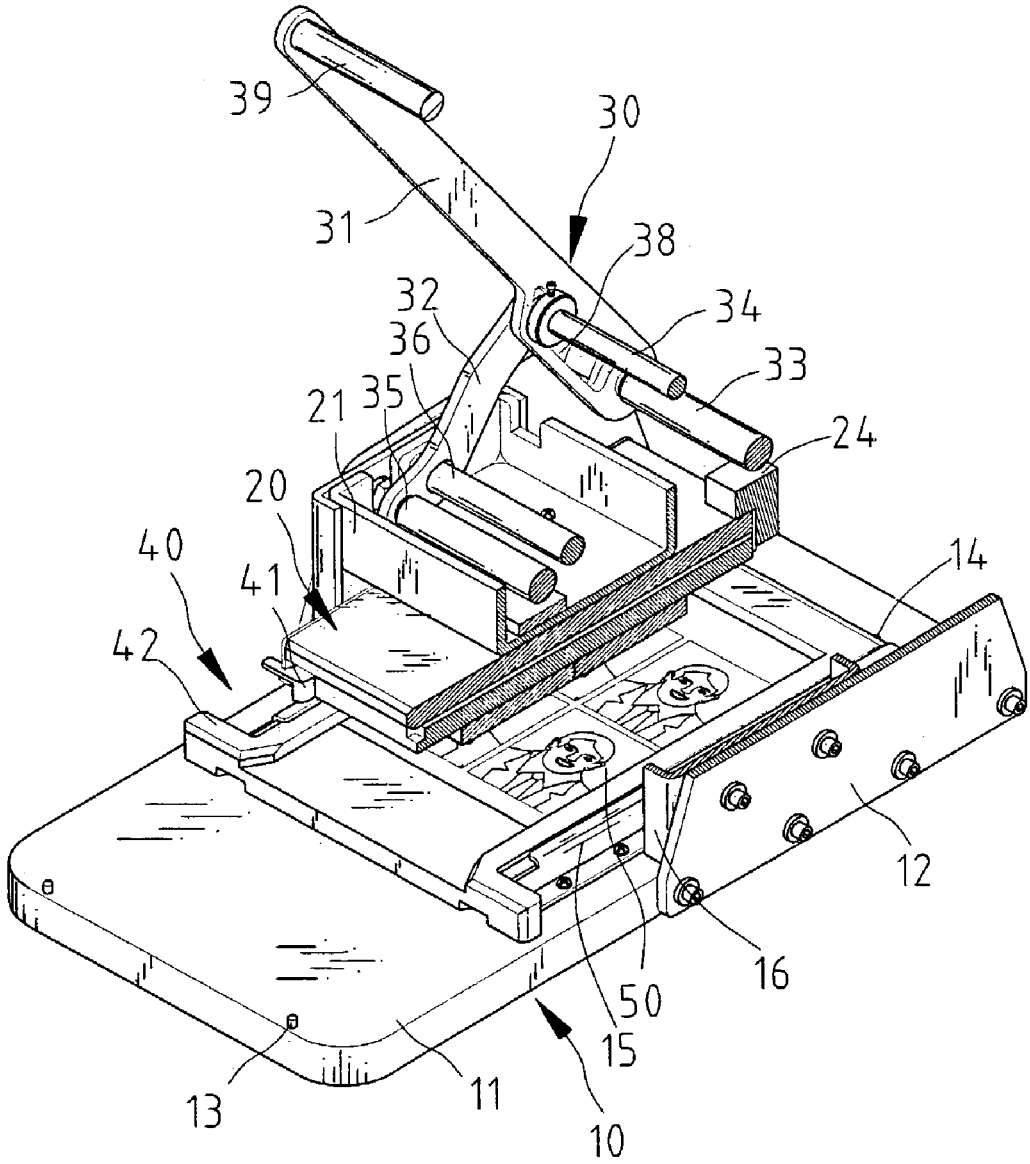
FIG. 4 is a cutaway view of the photo cutting apparatus shown in FIG. 1 ready to cut a sheet on which four photos are developed.
Figure 5:
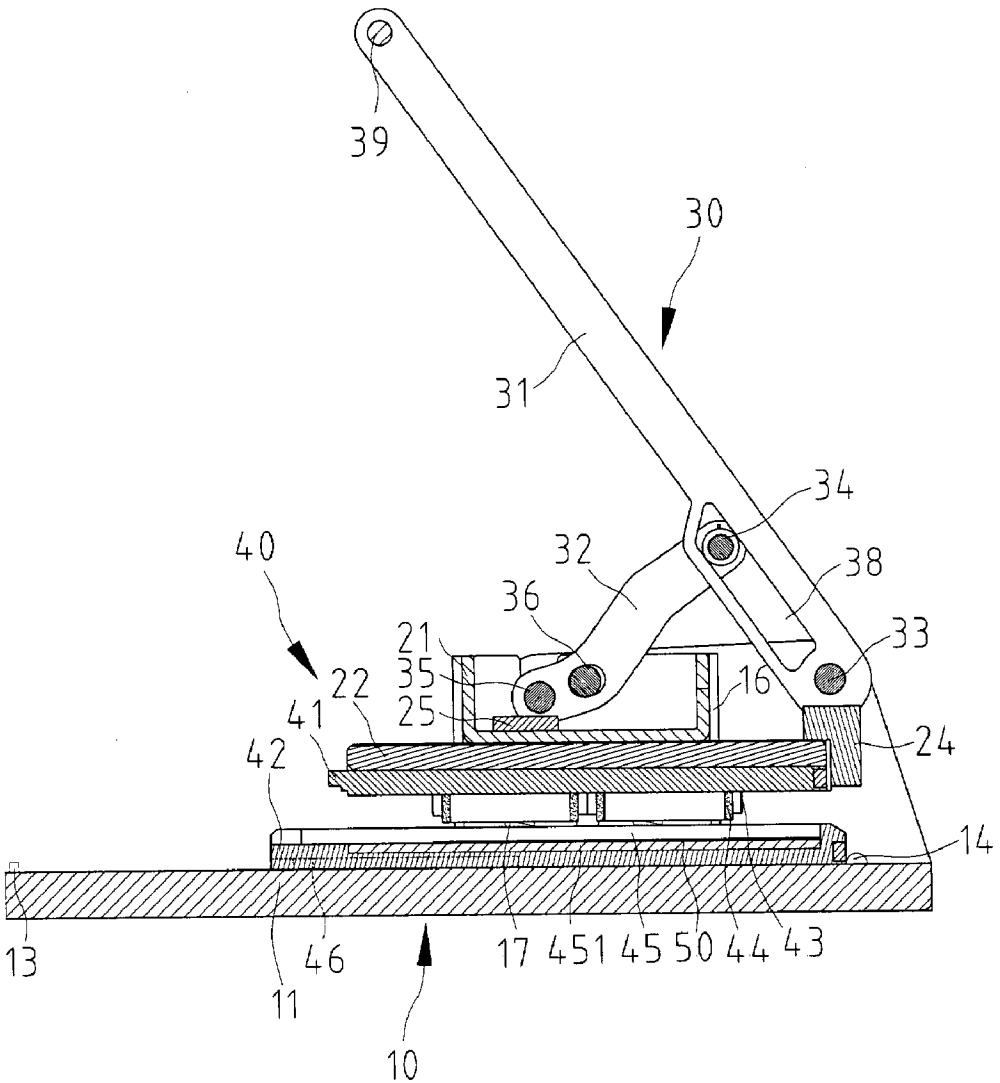
FIG. 5 is a cross-sectional view of the photo cutting apparatus shown in FIG. 4.
Figure 6:
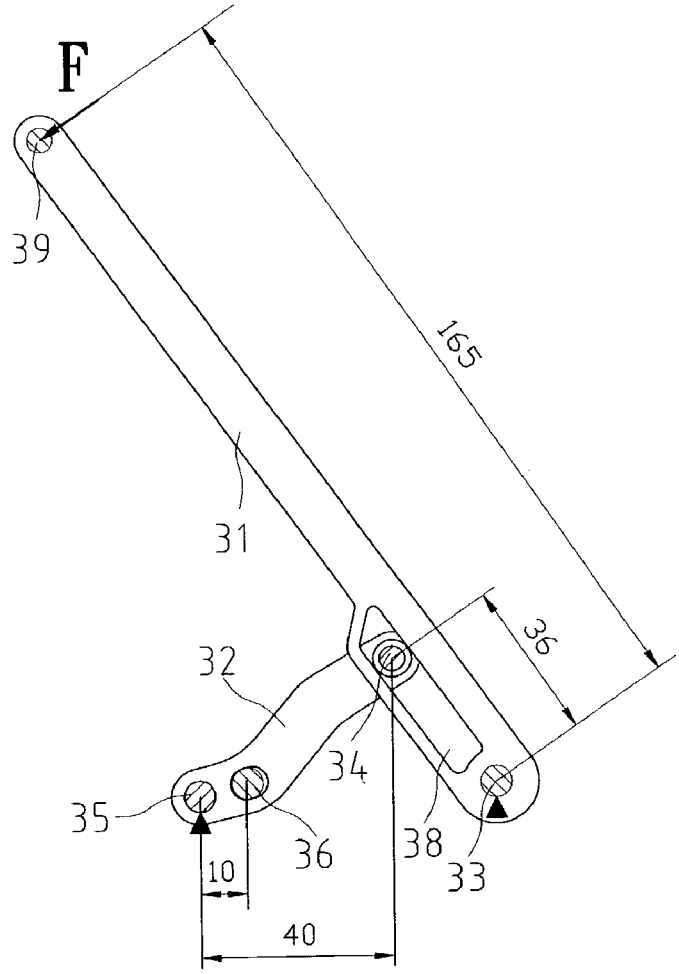
FIG. 6 is a cross-sectional view of a linkage of the photo cutting apparatus shown in FIG. 4.

Referring to FIGS. 4~6, the photo cutting apparatus is ready to separate the photos from one another. A counterclockwise angle from a line passing the axles 34 and 35 to a line passing the axles 34 and 33 must be greater than 90 degrees. Thus, counterclockwise pivoting of the levers 31 causes clockwise pivoting of the toggles 32 and, therefore, downward movement of the press 20 and the cutter 41. At the beginning of the pivoting of the levers 31, the pivoting of the toggles 32 takes place at a high speed. Due to the toggles 32 adopting an up-curved shape, the fast pivoting of the toggles 32 is transformed to fast downward movement of the press 20 and the cutter 41.

Figure 9:
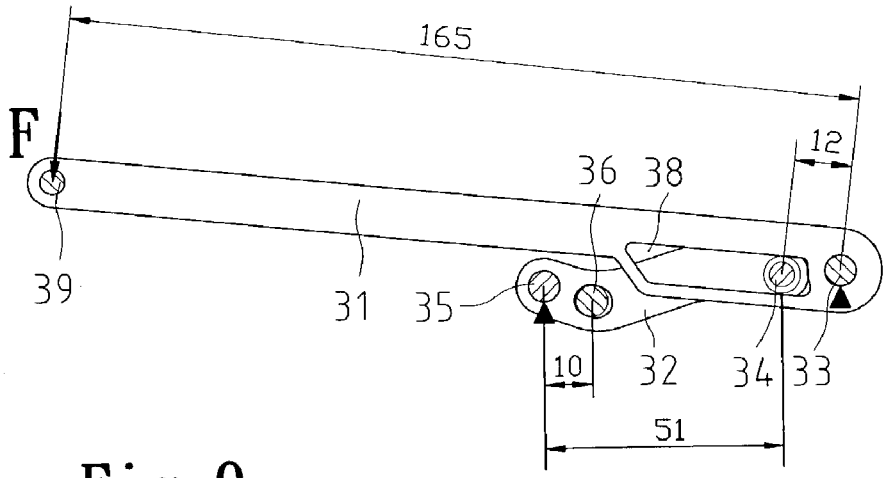
FIG. 9 is a cross-sectional view of the linkage of the photo cutting apparatus shown in FIG. 7.
Figure 7:
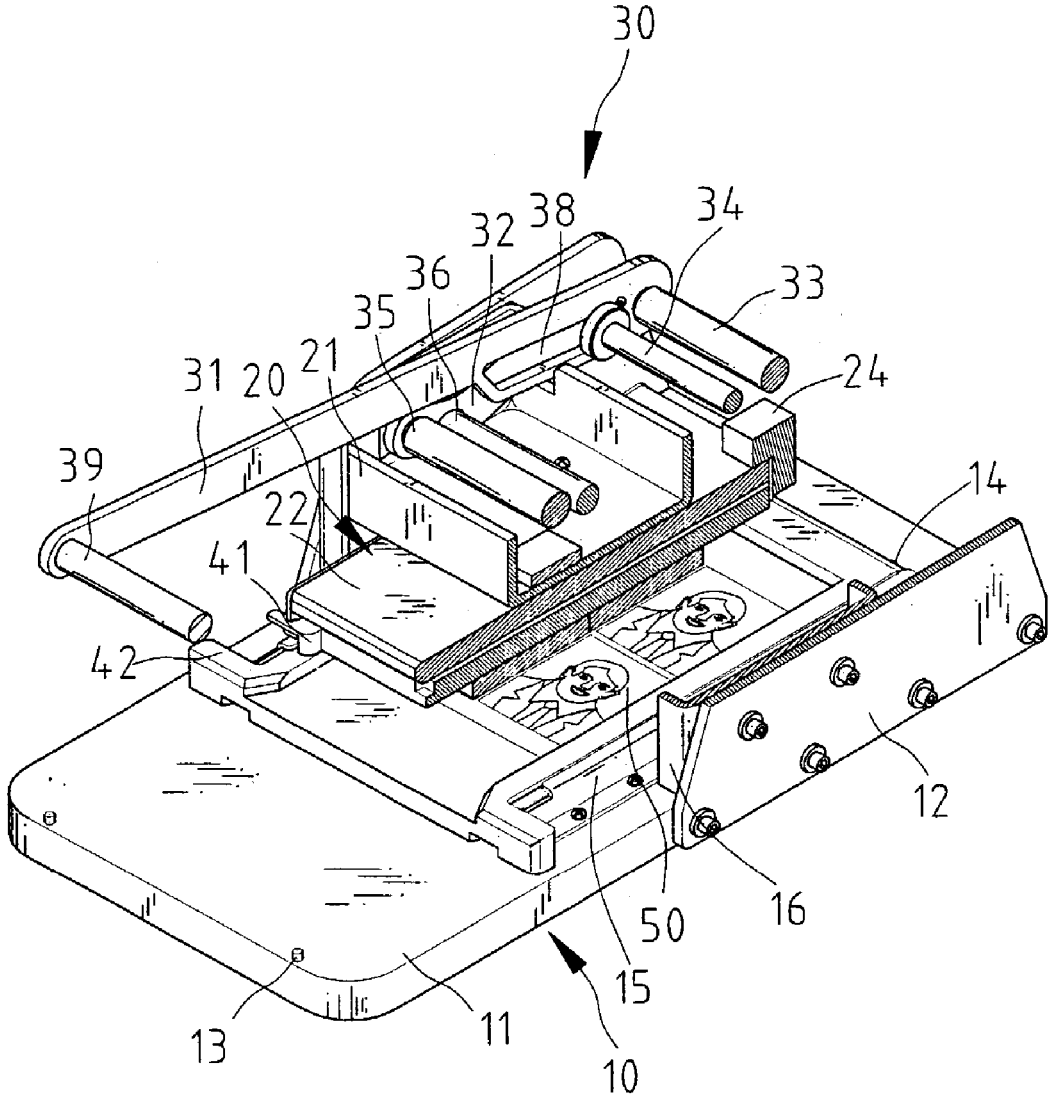
FIG. 7 is similar to FIG. 4 but showing the photo cutting apparatus cutting the sheet.
Figure 8:
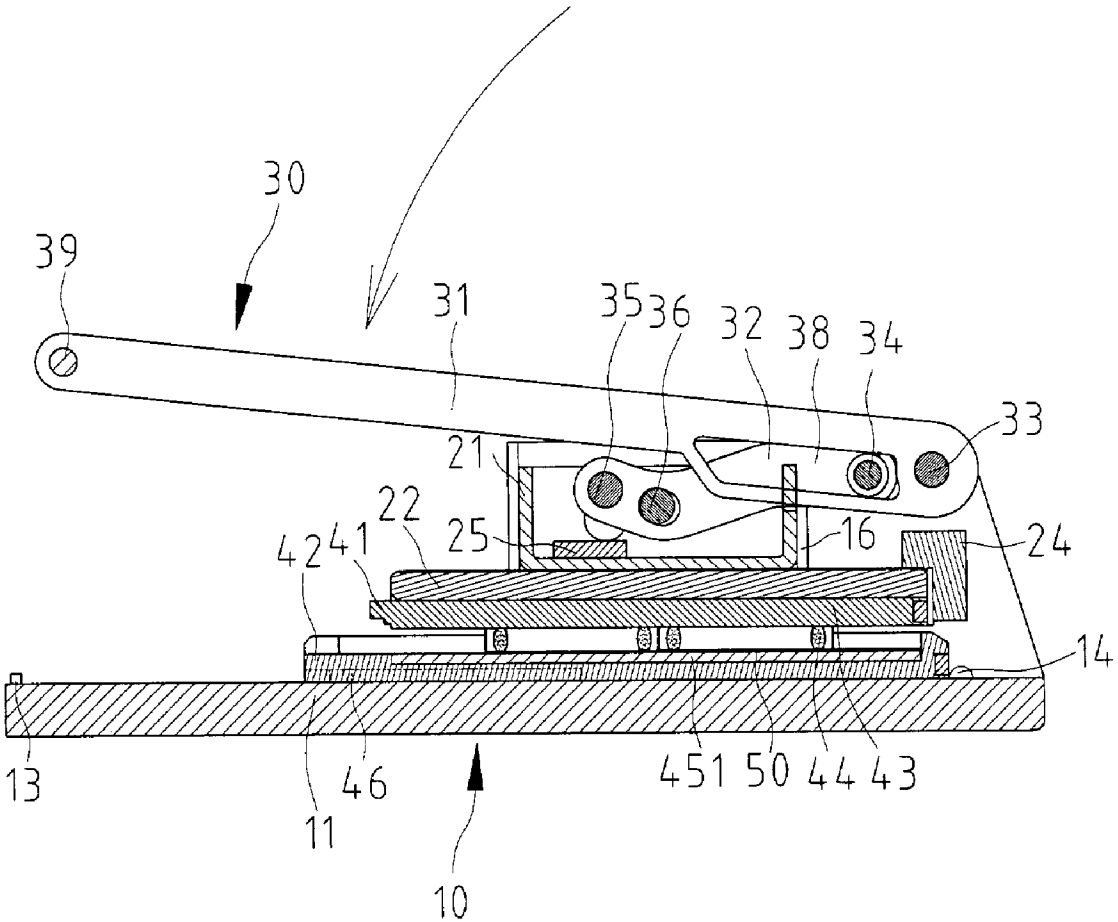
FIG. 8 is a cross-sectional view of the photo cutting apparatus shown in FIG. 7.

Referring to FIGS. 5, 8 and 9, at the end of the pivoting of the levers 31, the cutter 41 cuts the sheet 50. At this point, the linkage 30 provides a large mechanical efficiency. That is, a small force exerted on the handle 39 entails a large force exerted on the cutter 41.

Figure 10:
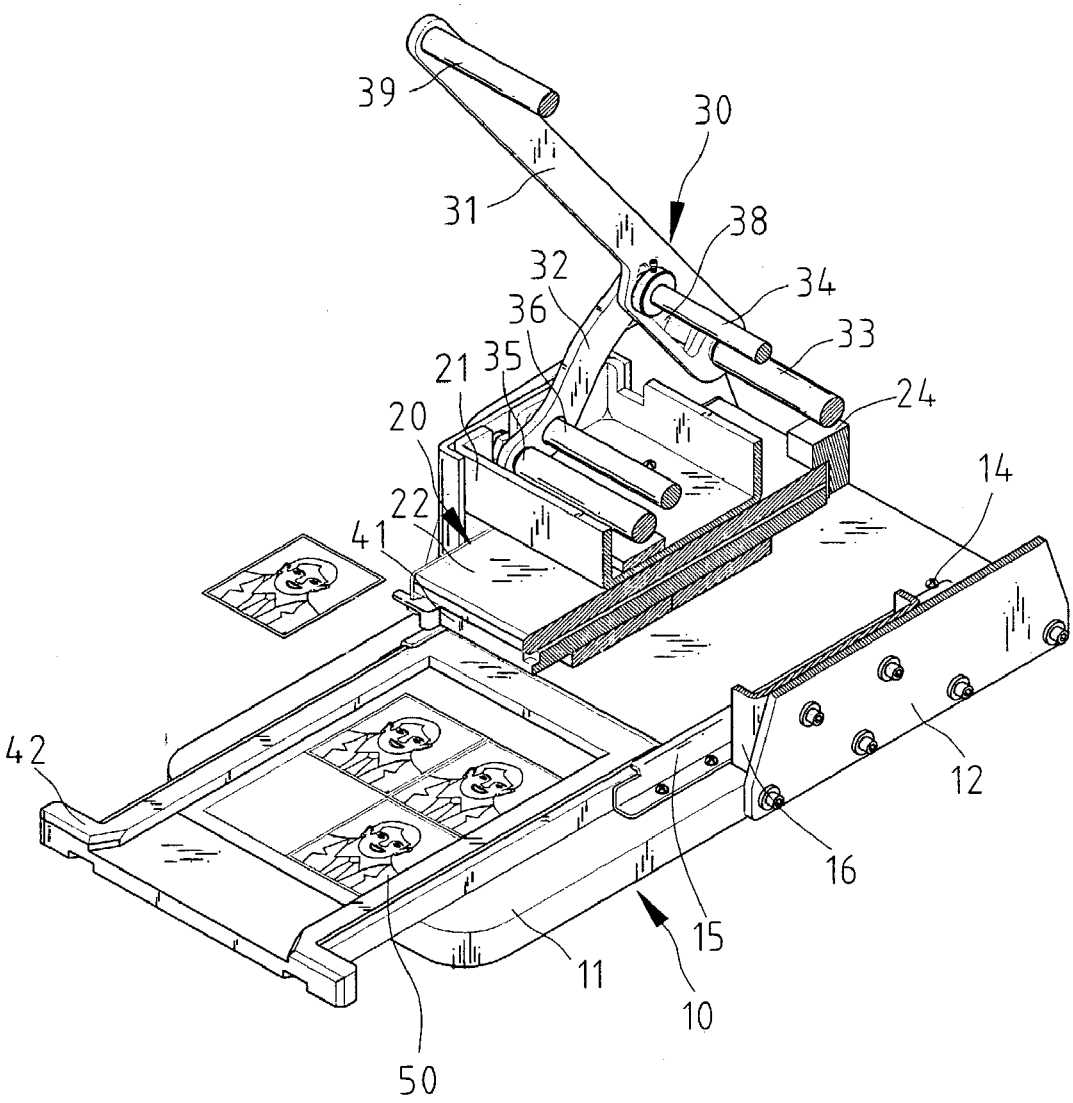
FIG. 10 is similar to FIG. 6 but showing the photos separated from one another.

Referring to FIG. 10, after the cutting, the four photos are separated from one another.

The handle 39 is released after the photos are separated from one another. If the handle 39 is released suddenly, the board 22 will be ejected by means of the springs 17 and cast on the axles 33 and 35. In that case, the pads 24 and 25 buffer the impact on the axles 33 and 35.

Figure 11:
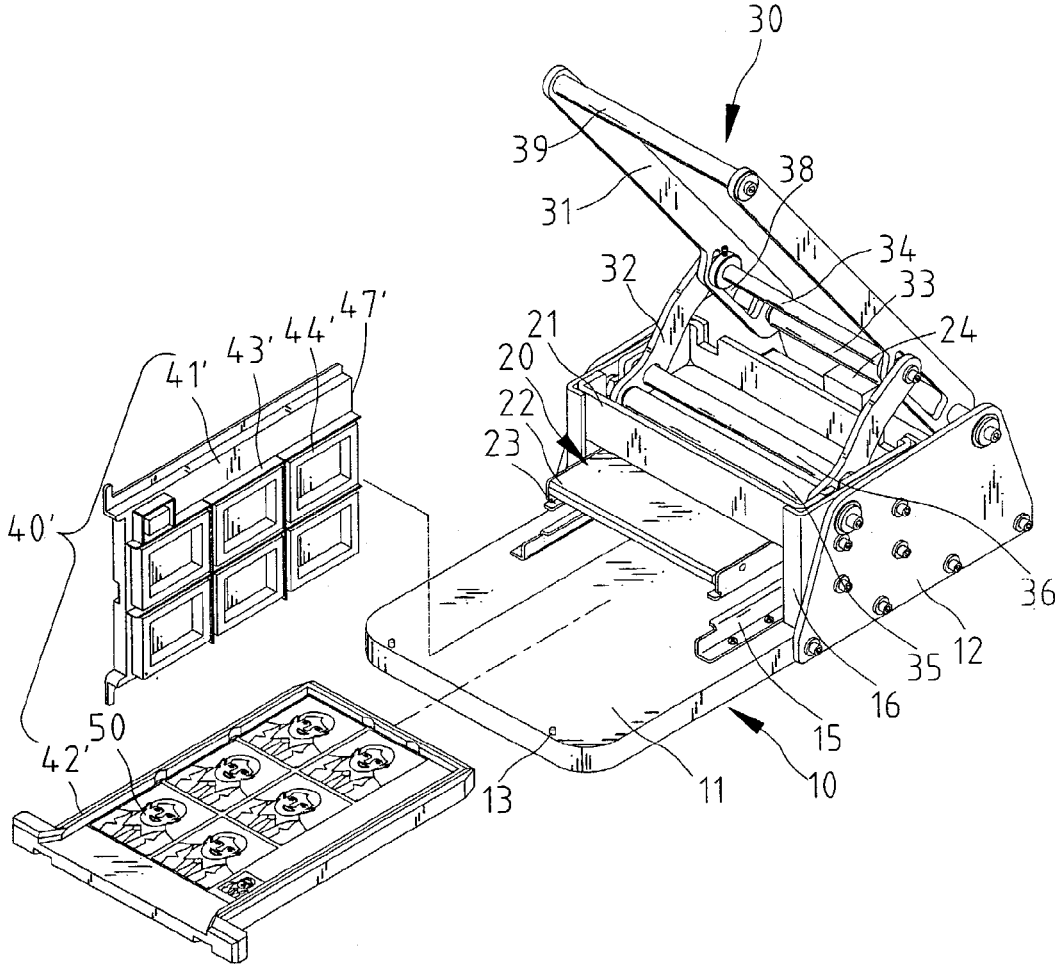
FIG. 11 is a cutaway view of a photo cutting apparatus according to a second embodiment of the present invention.
Figure 12:
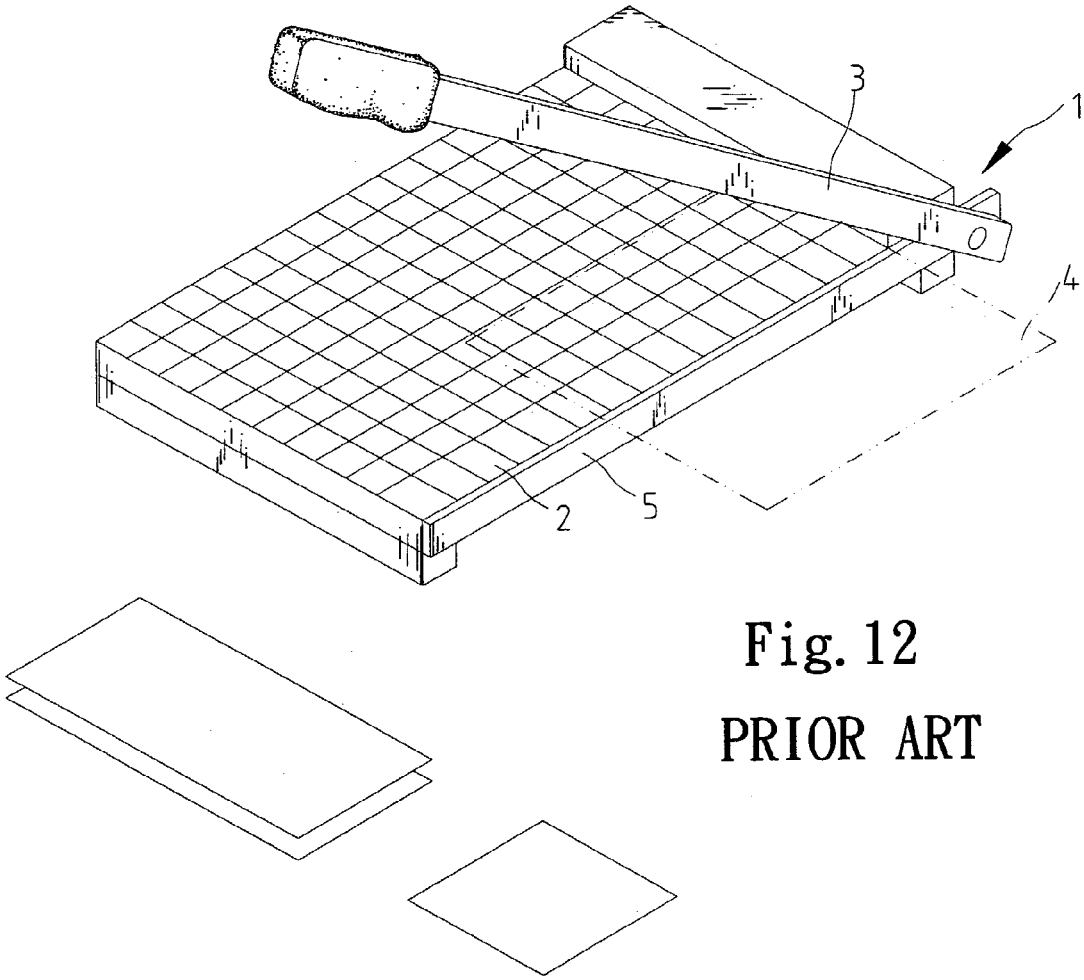
Fig. 12 PRIOR ART
FIG. 12 is a conventional paper shearing apparatus.

FIG. 11 shows a photo cutting apparatus according to a second embodiment of the present invention. The second embodiment is like the first embodiment except for using a cutting device 40' instead of the cutting device 40. The cutting device 40' includes a cutter 41' and an anvil 42'. The cutter 41' includes a board 47' and a blade 43' projecting from the board 47' for separating six photos developed on the sheet 50 from one another in a single action. Accordingly, the cutter 41' includes six elastic frames 44'. The anvil 42' defines a cavity larger than the cavity 45.

The present invention has been described via detailed illustration of embodiments. Those skilled in the art can derive many variations from the embodiments without departing from the scope of the present invention. Therefore, the embodiments shall not limit the scope of the present invention defined in the claims.

What is claimed is:

1. A cutting apparatus including:

a support;

a press movably mounted on the support, the support includes a platform and two walls formed on the platform;

a linkage for pressing the press, the linkage including:

a lever including a first end pivotally connected with the support and a second end;

a toggle including a first end pivotally connected with the support, a second end movably and pivotally connected with the lever;

a first axle mounted on the two walls for being pivotally connected with the first end of the lever;

a second axle mounted on the two walls for being pivotally connected with the first end of the toggle; and a third axle attached to the toggle between the first and second ends of the toggle;

a fourth axle extending from the toggle, the lever defining a slot in which the fourth axle extends; and a cutting device arranged between the support and the press for cutting photos developed on a sheet from one another in a single action, the platform being for supporting the cutting device.

2. The cutting apparatus of claim 1, wherein the linkage includes a second lever and a second toggle.

3. The cutting apparatus of claim 1 including springs compressed between the support and the press.

4. The photo cutting apparatus of claim 1, wherein a portion of the toggle between the first end and the second end of the toggle contacts the press when cutting photos.

5. The photo cutting apparatus of claim 1, wherein the lever has a handle at the second end of the lever, and a horizontal component of a distance between the second axle and the fourth axle incrementally increases when the linkage presses the press.

6. The cutting apparatus of claim 1 wherein the press includes a box-shaped element movably mounted on the support and a board attached to the box-shaped element for contact with the cutting device.

7. The cutting apparatus of claim 6 wherein the support includes two frames attached to the platform for sliding engagement with the box-shaped element.

8. The cutting apparatus of claim 1 wherein the cutting device includes:

an anvil for installment on the support in order to hold the sheet in position; and a cutter for contact with the press in order to cut the photos from one another in a single action.

9. The cutting apparatus of claim 8 wherein the anvil defines a cavity for receiving the sheet.

10. The cutting apparatus of claim 8 wherein the platform supports the anvil and includes two rails mounted for sliding engagement with two edges of the anvil.

11. The cutting apparatus of claim 10 wherein the platform includes two bosses formed thereon, and the anvil includes two grooves defined therein each for receiving one of the bosses.

12. The cutting apparatus of claim 8 wherein the cutter includes a board for contact with the press and a blade projecting from the board for cutting the photos from one another in a single action.

13. The cutting apparatus of claim 12 wherein the cutter assumes the form of a grid defining cells corresponding to the photos.

14. The cutting apparatus of claim 13 wherein the cutter includes elastic frames each fit in one of the cells defined by means of the blade for contact with one of the photos.

15. The cutting apparatus of claim 8 wherein the cutter is attached to the press in a releasable manner.

16. The cutting apparatus of claim 15 wherein the cutter includes a board for contact with the press and a blade projecting from the board for cutting the photos from one another in a single action, and the press includes a board and two rails attached to the board for sliding engagement with the board of the cutter.

17. The cutting apparatus of claim 16 wherein the cutter assumes the form of a grid defining cells corresponding to the photos.

18. The cutting apparatus of claim 17 wherein the cutter includes elastic frames each fit in one of the cells defined by means of the blade for contact with one of the photos.

* * * * *